US007178944B2

(12) United States Patent
Walton

(10) Patent No.: US 7,178,944 B2
(45) Date of Patent: Feb. 20, 2007

(54) LIGHTING APPARATUS

(76) Inventor: Randal D. Walton, 4215 Plass Dr., Napa, CA (US) 94558

( * ) Notice: Subject to any disclaimer, the term of this patent is extended or adjusted under 35 U.S.C. 154(b) by 0 days.

(21) Appl. No.: 10/393,816

(22) Filed: Mar. 21, 2003

(65) Prior Publication Data

US 2004/0184269 A1 Sep. 23, 2004

(51) Int. Cl.
*F21V 23/02* (2006.01)

(52) U.S. Cl. ..... 362/260; 362/297; 362/307; 362/343; 313/113; 313/635

(58) Field of Classification Search ..... 362/223, 362/260, 307, 343, 297; 313/111, 113, 635
See application file for complete search history.

(56) References Cited

U.S. PATENT DOCUMENTS 3,179,792 A * 4/1965 Weiss ..... 313/113
3,558,873 A * 1/1971 Smith ..... 362/223
6,033,092 A * 3/2000 Simon ..... 362/260
6,356,700 B1 * 3/2002 Strobl ..... 362/297

* cited by examiner

*Primary Examiner*—Stephen F Husar
(74) *Attorney, Agent, or Firm*—Kolisch Hartwell, P.C.

(57) ABSTRACT

The present invention comprises a method of enhancing illumination by a variety of lamp types through the use of reflective technologies, for example, replacement of expensive high intensity density or mercury vapor lamps with low wattage flourescent tubes having at least one and in some cases, up to three reflective surfaces for focusing otherwise lost light toward a target illumination area. Further, the placement of light sources at the focal point of said reflective surfaces aids in optimizing the amount of light focused in a desired direction.

14 Claims, 9 Drawing Sheets

LIGHTING APPARATUS

FIELD OF THE INVENTION

The instant invention may be considered to be in the field of lighting devices, specifically lamps of high intensity discharge and flourescent lamps, but not limited thereto.

BACKGROUND OF THE INVENTION

Many industrial and commercial buildings have the burden of illuminating large areas from standard height as well as from higher than normal ceilings. One solution to this lighting application has been the use of high intensity discharge lamps. Mercury vapor, sodium and other high intensity discharge lamps in commercial applications may consume as much as 400 to 1000 watts, and generate an associated amount of heat, contributing to additional heating, ventilating and air conditioning ("HVAC") operation and fire protection considerations.

These lamps also utilize a certain time duration to warm up and achieve full illumination capability, resulting in time periods with less than desired lighting coverage. Such high intensity discharge lamps are also relatively expensive costing several hundreds of dollars per lamp.

Lamp manufacturers are constantly looking for ways to maximize the amount of foot candles of illumination which can be generated for a fixed amount of power consumption or wattage. These objectives have resulted in the evolution of high intensity discharge lamps which bum metallic vapors to achieve high lumen output.

A fairly common discharge lamp with a reflective lamp is disclosed in U.S. Pat. No. 6,291,936 B, issued Sep. 18, 2001 to MacLennan et al. Summarizing, the MacLennan patent discloses a discharge lamp including an envelope, a source of excitation power coupled to the fill for excitation thereof and thereby emit light, a reflector disposed around the envelope and defining an opening, and a reflector configured to reflect some of the light emitted by the fill back into the fill while allowing some light to exit through the opening. This description is typical of a high intensity discharge lamp. The high pressure sodium lamp emits the brightest light while metal halide and mercury vapor lamps emit about the same amount of light. For a lamp in the 400 W range, for example, a ballast which acts as the excitation for the fill may typically consume 40 to 58 watts.

Flourescent lamps are also used in commercial applications, often in offices and warehouses where a plurality of flourescent tubes are positioned in front of a washboard-shaped, mirrored reflector. The purpose of the reflector is to reflect the light emitted upward back down toward the targeted illumination area. Flourescent lamps differ from high intensity discharge lamps in that the "strike" time (the time to excite the interior of the lamp) is short—almost immediate, where the high intensity discharge lamps must warm up to full illumination. Flourescent lamps also operate at a cooler temperatures than do high intensity discharge lamps. The same approach may be applied to retrofitting existing installations in the commercial office environment.

Flourescent lamps are also used in residential applications. A growing trend is the replacement of incandescent lamps with flourescent lamps to achieve not only brighter light, but also savings in power consumption.

Lamps like the Sylvania ICETRON™ lamp are touted as having a 100,000 hour lamp life, or roughly five times the life of a standard high intensity discharge lamp. Consequently, with such added lamp life, the amount of maintenance required to change lamps in order to maintain illumination is reduced by 80%.

When one examines the shortcomings attendant to the use of high intensity discharge lamps and the advantages of flourescent lamps, several observations result. By comparison, flourescent lamps provide crisp white light in comparison to high intensity discharge lamps which offer unpleasant color and distracting color shift. Flourescent lights may also be flexibly dimmed whereas high intensity discharge lights may not be operated below 50% output.

What is needed is a lamp which can illuminate a target area with the same amount of foot candles as a high intensity discharge lamp without consuming the same amount of energy, without requiring a warm-up period, and in operation generating less heat.

There exists a further need for high intensity discharge lamps which can illuminate a target area with the same amount of foot candles as a higher wattage, high intensity discharge lamp without consuming the same amount of energy.

Also, what is needed is a lamp which can illuminate a target area with the equivalent of foot candles as an incandescent lamp, but without consuming the same amount of energy.

Further, if the illuminating capability of a high intensity discharge lamp could be accomplished without the high capital cost associated with the purchase and operation of such lamps, the relative operating cost of illuminating industrial and commercial buildings would be reduced. The same can be said for the improvement of residential illumination as well.

If such a lamp as described immediately above were developed, the cost of retrofitting fixtures with such lamps would be paid for relatively quickly by the associated savings from reductions in energy consumption.

One area of the art that remains to be fully developed is the optimal use of reflective surfaces to assist in directing light which would normally travel away from the targeted illumination area.

SUMMARY OF THE INVENTION

The present invention combines the advantages of compact flourescent light tubes with reflective technology aimed at retrofitting high intensity discharge lamps in industrial and commercial applications. Applicant's invention also combines the advantages of high intensity discharge, incandescent and other light sources with reflective technology aimed at retrofitting each type of lamp for industrial, commercial, and residential applications.

By using a combination of cooler operating flourescent tube lamps with concentrating reflective surfaces, an equivalent illumination result can be achieved at a reduction in energy consumption in the range of 40% to 74%. As a result of the much lower cost of a compact flourescent lamp, multiple lamps may be used in combination to generate the equivalent illumination of a target area as that of high intensity discharge lamps.

The present invention utilizes reflective surfaces in a variety of ways to increase the intensity of light delivered to the target illumination area.

First, the lamp glass may be manufactured having a reflective surface to reflect light which would normally emanate away from the target illumination area back toward the target area, thereby increasing the amount of light delivered to said target illumination area ("TIA").

Second, a housing which is normally used for lamps such as a semi-conical or paraboloid-shaped high bay fixture, or a flat "washboard" type reflector may be retrofitted with a combination lamp and reflector which not only uses whatever reflective capability exists in the housing, but adds its own intensity focus factor to deliver light to the TIA, even delivering an equivalent amount of light at much less of a wattage rating (and therefor less power consumption) than the original lamp or lamps in the housing.

In a first embodiment of the present invention, a spiral fluorescent tube is combined with an interior spiral reflector and a single secondary paraboloid reflector. A third reflector such as a semi-conical or paraboloid shape can be utilized by positioning the floodlight fixture at the focal point of said reflector. Important in this case is the distance between the tubes themselves as well as between each tube and its associated reflectors.

The importance stems from the amount of space needed to allow the reflector to bounce light back past the tubes and toward the TIA, and also the space needed for dissipation of heat. Convection allows cool air to be drawn pass the fins and dissipating heat will protect the ballast. The compact fluorescent floodlight has a lens designed to precisely control the light from the reflector. It is covered with small, detailed shapes to direct the light into the desired beam pattern. The lens also acts as a cover to allow the lamp to act as its own fixture.

A second embodiment of applicant's invention employs an "implant" consisting of a spirally configured fluorescent or compact fluorescent lamp which is fitted with a reflective surface proximate to the interior portion of the lamp itself. This implant may be retrofitted into a conventional high-bay industrial fixture, thereby delivering an equivalent amount of light to the TIA with less wattage consumed. Each spiral lamp has proximate to it a primary reflector to re-direct light which might otherwise be "lost," meaning not directed to the TIA, and as well, a secondary reflector which helps direct the light to a third reflector which finally directs the focused light to the TIA.

A third embodiment of applicants invention employs a high intensity discharge compact fluorescent lamp consisting of an array of "spirally" configured fluorescent lamps, each fitted with a reflective surface proximate to the interior portion of the lamp itself. This "HID" may be retrofitted into a conventional high-bay industrial fixture, thereby delivering an equivalent amount of light to the TIA with less wattage consumed. As in the case of the second embodiment, each spiral lamp has proximate to it a primary reflector to re-direct light which might otherwise be "lost", meaning not directed to the TIA, and as well, a secondary reflector which helps direct the light to a third reflector which finally directs the focused light to the TIA. This triple reflective light fixture could be placed in a fourth semi-conical or paraboloid shape reflector and can be utilized by positioning the floodlight fixture at the focal point of said reflector to increase the foot candles at the TIA and reduce energy consumption. Fins allow cool air to be drawn in with dissipating heat can protect the ballast. The compact fluorescent floodlight has a lens designed to precisely control the light from the reflector. It is covered with small, detailed shapes to direct the light into the desired beam pattern, but could also be smooth. The lens also acts as a cover to allow the lamp to act as its own fixture.

In a fourth embodiment, a plurality of spiral lamps having primary reflectors is positioned inside a plurality of secondary reflectors. This array of lamps is then positioned inside a single third reflector having its own focusing characteristics, thereby further optimizing the delivery of light to the TIA. Consistent with applicant's approach, the array is positioned at the focal point of the third reflector.

In a fifth, or preferred embodiment, of the instant invention a light source is positioned at the focal point of a reflective surface which optimizes the amount of light which is directed to the TIA. In this embodiment, a small wattage fluorescent tube is placed inside a second tube having a partially reflective surface and in some cases, a partial lens. An all-in-one open "said" Reflector Lamp can also be used by placing a smaller lamp at the focal point of said reflector. The placement of the smaller fluorescent tube is determined by the focal point of the second outer tube, thereby dependant upon the diameter of the second outer tube.

In a sixth embodiment of the present invention, a U-shaped tube is positioned at the focal point of a reflective surface thereby optimizing the amount of light which is directed to the TIA. Also, in this embodiment, a small wattage fluorescent tube is placed inside another tube or concave, open reflector having a partially reflective surface.

In a seventh embodiment of the instant invention, a high intensity discharge lamp employs a light source at the focal point of a reflective surface again optimizing the amount of light which is directed to the TIA. In this embodiment, a small wattage HID "said invention" Reflector Lamp is placed at the focal point of an outer second reflective surface. The placement of the small light source is again determined by the focal point of the bulb.

In another embodiment, an incandescent lamp employs a light source at the focal point of a reflective surface which optimizes the amount of light which is directed to the TIA. In this embodiment, a small wattage incandescent "same said" Reflector Lamp is placed at the focal point of an outer second reflective surface. The placement of the small light source is determined by the focal point of the bulb.

As one can see, a variety of different shaped lamps can be positioned in the focal point of a reflective surface, even taking advantage of a reflective surface with multiple facets, thereby increasing the amount of light reflected toward the TIA. The placement of the light is typically determined by the focal point of the reflector, thereby dependant upon its diameter. The resultant light delivered to the TIA is consistent with the valves expressed in Tables A, B, and C The resultant light delivered to the TIA is consistent with the values expressed in Tables A, B and C.

Table A is a comparison of flourescent lamps having employing multiple reflections versus high intensity discharge and flourescent lights utilizing only a single reflector.

TABLE A

Present Embodiment Compared to Improved High Bay Apparatus

| Lamp type with Ballast | Initial Fix Lumens (IL) | Maintained Lumens (ML) | Convert (ML) to Foot Candles (FC) | 3rd Mirror Reflector ≈67% Increase (FC) | 2nd Mirror Reflector ≈67% Increase (FC) | 1st Mirror Reflector ≈67% Increase (FC) | Energy Consumed (Watts) | Reduced Load (%) | Annual Operating Cost (40 hr/wk) |
|---|---|---|---|---|---|---|---|---|---|
| High Pressure Sodium | 32000 | 20,800 | 1,655 | No | No | 2,764 | 458 | 0 | $191.05 |
| Metal Halide | 28,800 | 17,280 | 1,343 | No | No | 2,242 | 458 | 0 | $191.05 |
| Mercury Vapor | 26,667 | 16,000 | 1,273 | No | No | 2,126 | 458 | 0 | $191.05 |
| 6 × T8 4' Tube Fluorescent | 18,000 | 17,100 | 1,361 | No | No | 2,273 | 224 | 51.1% | $93.44 |
| Compact Fluorescent | 7,263 | 6,900 | 549 | No | No | 917 | 105 | 77.1% | $43.80 |
| 4 × T5 4' Tube Fluorescent | 20,000 | 19,000 | 1,512 | No | No | 2,525 | 234 | 48.9% | $97.81 |
| Compact Fluorescent | 13,126 | 12,470 | 992 | No | 2,767 | 1,657 | 191 | 58.3% | $79.67 |
| 4 × 30 Implant Fluorescent | 7,895 | 7,500 | 597 | 2,781 | 1,665 | 997 | 120 | 73.8% | $50.06 |

Table B is a similar comparison of residential or commercial lamps versus the same lamps utilizing reflectors.

TABLE B

Comparison of Present Embodiment to Improved Lighting Apparatus

| Lamp type | Initial Fix Lumens (IL) | Maintained Lumens (ML) | Convert (ML) to Foot Candles (FC) | 3rd Mirror Reflector ≈67% Increase (FC) | 2nd Mirror Reflector ≈67% Increase (FC) | 1st Mirror Reflector ≈67% Increase (FC) | Energy Consumed (Watts) | Reduced Load (%) | Annual Operating Cost (40 hr/wk) |
|---|---|---|---|---|---|---|---|---|---|
| 4' × T5 Fluorescent | 5,000 | 4,750 | 378 | No | No | No | 54 | 0 | $22.53 |
| 4' × T5 Improved Fluorescent | 3,000 | 2,850 | 227 | No | No | 378 | 32 | 41% | $13.35 |
| 4' × T8 Fluorescent | 3,000 | 2,850 | 227 | No | No | No | 32 | 0 | $13.35 |
| 4' × T8 Improved Fluorescent | 1,786 | 1,707 | 136 | No | No | 227 | 19 | 41% | $7.99 |
| Compact Fluorescent | 3,684 | 3,500 | 279 | No | No | No | 55 | 0 | $22.94 |
| Improved Compact Fluorescent | 2,206 | 2,096 | 167 | No | No | 279 | 33 | 40% | $13.73 |
| Compact Fluorescent Flood | 3,684 | 3,500 | 279 | No | No | 466 | 55 | 0 | $22.94 |
| Improved Compact Fluorescent Flood | 2,206 | 2,096 | 167 | No | 466 | 279 | 33 | 40% | $13.73 |
| Improved Compact Fluorescent Flood | 1,321 | 1,255 | 100 | 466 | 279 | 167 | 20 | 64% | $8.24 |

Table C is a similar comparison of high intensity discharge lamps and an incandescent lamp employing at least primary and secondary reflectors verses the same lamp technology employing only a single reflector.

TABLE C

Comparison of Present Embodiment to Improved Lighting Apparatus

| Lamp type with Ballast | Initial Fix Lumens (IL) | Maintained Lumens (ML) | Convert (ML) to Foot Candles (FC) | 3rd Mirror Reflector ≈67% Increase (FC) | 2nd Mirror Reflector ≈67% Increase (FC) | 1st Mirror Reflector ≈67% Increase (FC) | Energy Consumed (Watts) | Reduced Load (%) | Annual Operating Cost (40 hr/wk) |
|---|---|---|---|---|---|---|---|---|---|
| High Pressure Sodium | 32000 | 20,800 | 1,655 | No | No | 2,764 | 458 | 0 | $191.05 |
| Metal Halide | 28,800 | 17,280 | 1,343 | No | No | 2,242 | 458 | 0 | $191.05 |
| Mercury Vapor | 26,667 | 16,000 | 1,273 | No | No | 2,126 | 458 | 0 | $191.05 |
| High Pressure Sodium | 19,000 | 12,350 | 983 | No | 2,742 | 1,642 | 175 | 56% | $73.00 |
| Metal Halide | 18,133 | 10,858 | 864 | No | 2,410 | 1,443 | 200 | 50% | $83.43 |
| Mercury Vapor | 19,194 | 11,494 | 915 | No | 2,553 | 1,529 | 225 | 44% | $93.86 |
| General Purpose Lamps Incandescent | 1,200 | → | 96 | No | No | 160 | 100 | 0 | $41.71 |
| Improved General Purpose Lamps Incandescent | 719 | → | 58 | No | 160 | 96 | 60 | 40% | $25.03 |

The focal point is determined using the formulas developed to describe light reflected from a concave mirror. The equation may be expressed as f=R/2, where R is the radius of the mirror (in the case of the preferred embodiment, the outer tube) and f is the focal length, or distance from the mirror where the light source should be placed for optimal reflection.

Graph 1 shown in FIG. 16 illustrates how the various types of lamps; i.e., flourescent, halogen, mercury vapor and high pressure sodium compare with one another. As can be seen from the table, the flourescent bulb has a higher color rendition index, or "CRI" than other lamp media utilizing the same wattage rating of power consumption.

Graph 2 shown in FIG. 17 shows the asymptotic relationship between an object's distance from the focal point of a reflector and the associated magnification.

Summarizing, the embodiments shown herein comprise seven examples of applicant's invention:

First, a compact or fluorescent lamp such as that already available on the open market, be it spiral, U-shaped, or other configuration, is fitted with a conical (or a variety of other shapes such as concave, or a flat washboard) reflector proximate to the exterior of the lamp glass itself The purpose of the reflector is to redirect light toward the TIA which would normally scatter in all directions. This Reflector Lamp combination may also be used in conjunction with a single secondary reflector in a combination akin to what is commonly referred to as a floodlamp. Type apparatus, the positioning of the lamp or lamps in said secondary reflectors proximate to the focal points thereof.

Second, an embodiment comprising a plurality of spiral fluorescent or compact fluorescent lamps each having a primary reflector is positioned inside a secondary reflector at the focal point forming an array. In this embodiment, a third reflector is employed at the focal point to provide additional direction or focusing of light toward the TIA.

The third embodiment utilizes a small fluorescent tube of low wattage place proximate to the focal point of a larger tube having, in the preferred embodiment, a reflective hemisphere acting as a primary reflector. In this configuration, light may be directed with substantial increased intensity to the TIA, and when used with a secondary reflector, may provide even more intensity to the TIA.

The fourth embodiment utilizes the amount of space needed for reflector and tubes to allow cool air to flow pass the space between reflector and tubes as heat dissipates. Fin spacing allows cool air to pass the fins thereby dissipating heat. Over heating will deteriorate lamp life of the fluorescent ballast.

A fifth embodiment of applicants invention comprises, the compact fluorescent floodlight with a lens designed to precisely control the light emanating from the reflector. Although it could be smooth, it is covered with small, detailed shapes to direct the light into the desired beam pattern. The lens also acts as a cover to allow the lamp to act as its own fixture.

A sixth embodiment of applicants invention comprises, high-intensity discharge lamps (high pressure sodium one of the most efficient HID sources available today. These lamps are used for general lighting applications where high efficiency and long life are desired while color rendering is not critical. Typical applications include street lighting, industrial hi-bay, parking lot lighting, building floodlighting and general area lighting) with a light emitting source at the focal point of a reflective surface which optimizes the amount of light directed to the TIA. The placement of the small light emitting source is determined to be at the focal point of the reflective hemisphere of the outer tube, thereby being determined by said outer tubes diameter.

A seventh embodiment of applicants invention comprises, incandescent lamps with a light emitting source at the focal point of a reflective surface which optimizes the amount of light directed to the TIA. The placement of the small light emitting source is determined to be at the focal point of the reflective hemisphere of the outer tube, thereby being determined by said outer tubes diameter.

DETAILED DESCRIPTION OF THE INVENTION

Figure 1:
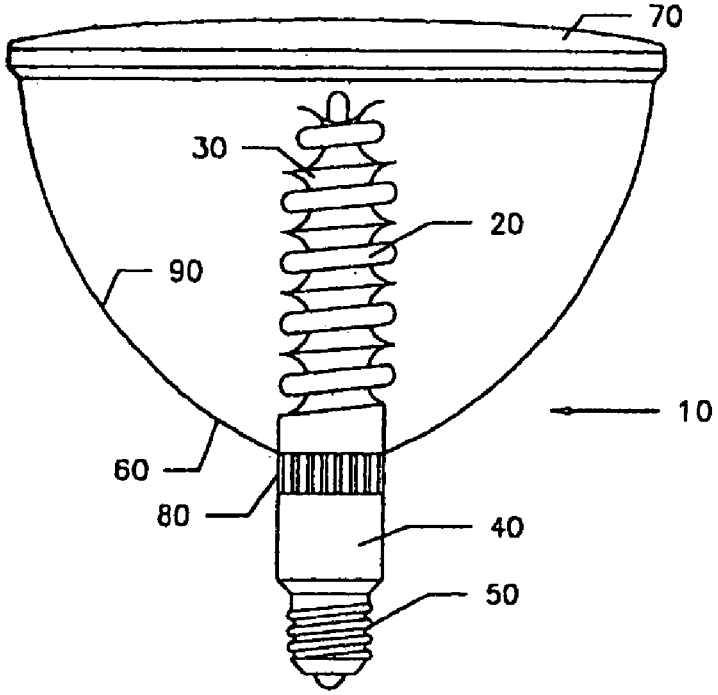
FIG. 1 is a side view of the first embodiment showing a spiral compact fluorescent tube at the focal point of a primary reflector proximate thereto and positioned at the focal point of a secondary reflector, in a configuration commonly referred to as a "floodlight;"

As seen in FIG. 1, a flood light 10 comprises a spiral compact fluorescent lamp 20 around which a primary reflector 30 is positioned. A first bonding means, such as glue or other adhesive or mechanical means is employed to fix lamp 20 and primary reflector 30 in a predetermined position. Lamp 20 is constructed in accordance with typical fluorescent lamps, comprising phosphor coating is applied to the inside of the tube with hot cathodes at each end of lamp. Air is exhausted through the exhaust tube during manufacture and an inert gas is introduced into the bulb. A minute quantity of liquid mercury with gas, the gas is usually argon. The stem press has lead-in-wires connecting the base pins and carry the current to and from the cathodes and the mercury arc. Reflector 30 may be fashioned from a variety of materials including but not limited to chrome-plated glass, chrome-plated metal, polished or painted aluminum plate, painted glass, and painted plastic with a variety of reflective coatings. When utilizing molded metal for reflector 30, "mirro 4", "mirro 27" or white reflective aluminum may be selected. Commonly configured, a ballast housing 40, contains a ballast of either electrical or magnetic type, said ballast having a connecting means for electrical connection to lamp 20 and screw plug 50. A second bonding mean is necessary to attach housing 40 to lamp 20. While a bonding means is specified, other means, mechanical or otherwise, may be employed. In addition, ballast housing 40 and screw plug 50 could be fashioned as one unit rather than as separate structures, said unit having either glass, plastic, ceramic or other typical construction known in the art. The area of ballast housing 40 through screw plug 50 is typically fashioned from brass. A secondary reflector 60 in combination with a lens 70 encloses the lighting apparatus. Lens 70 can be made of glass or plastic. Fins 80 are provided on ballast housing 40 to assist in the dissipation of heat.

Secondary reflector 60, in the preferred embodiment, is of paraboloid shape, with its inner surface having a reflective coating 90 said reflector may be fashioned typically from glass, plastic, or metal.

Figure 2:
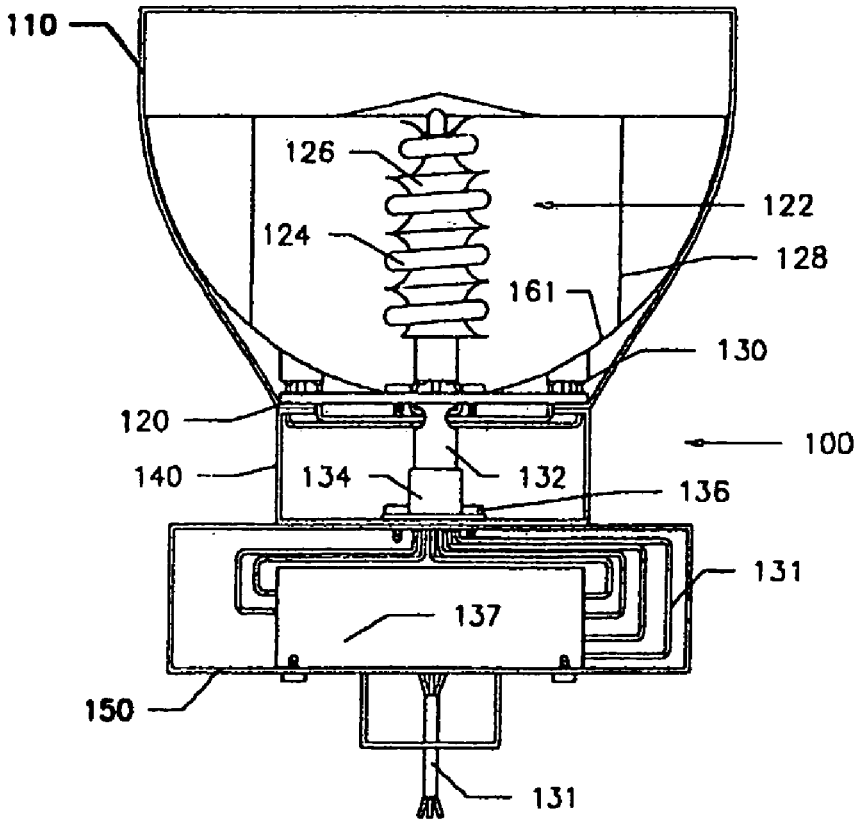
FIG. 2 is a side view of the second embodiment of applicant's invention, disclosing a plurality of spiral fluorescent tubes having primary reflectors positioned as an array and having also secondary reflectors, said array positioned in a third reflector each at its focal point.

FIG. 2 discloses an embodiment 100 of applicant's invention which is primarily employed as a retrofit of existing high bay fixtures. The common housing 110 provides a dual function as a support for a frame 120, said frame fashioned to hold an array 122 of fluorescent lamps 124 having primary reflectors 126. Array 122 further comprises a secondary reflector 128 commonly of assembled sections. Assembled sections are put into third reflector 161. Electrical connections 130, to which electrical wires 131 are attached, are positioned below frame 120 and are fed through a platform 132 and through a transition piece 134, to a fastening means 136. Fastening means 136 fixes secondary housing 140 and therefore housing 110, to a ballast housing 150. Commonly known and appropriately rated ballasts 137 are contained within ballast housing 150, through which the electrical wires 131 again pass. These electrical wires may be hard wired to a lighting circuit.

When utilizing embodiment number two for retrofitting a typical high bay fixture such as that disclosed in U.S. Pat. No. 6,068,388 (See sheet 1 of 6), the capacitor and igniter in part 12 are replaced with a ballast. The wiring is kept along with the structure there above. The core and coil which is housed in the space adjacent to part 12 is removed. Part 12 may be then fastened to secondary housing 18, each of which can be utilized in addition to reflector 21. All other numbered parts are replaced by those items listed above and below and shown in FIG. 2 and FIG. 3.

A typical high bay fixture can be retrofitted, the capacitor and igniter are replaced with an appropriate capacitor and inginter for a lower wattage high pressure sodium, metal halide, or mercury vapor lamps. The wiring is kept along with the structure thereabove. The core and coil which is housed in the space adjacent to part 12 shown above in U.S. Pat. No. 6,068,388 is replaced with the appropriate core and coil for the lower wattage lamp. All other numbered parts are replaced by those items listed below as shown in FIG. 2 and FIG. 3.

Figure 3:
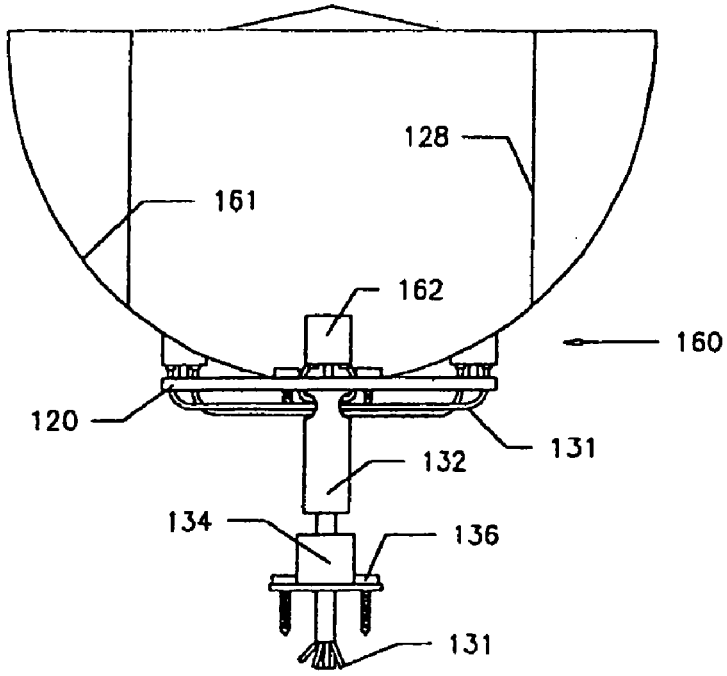
FIG. 3 is a side view of the aforementioned "implant", which may be utilized with a variety of light sources such as the spiral fluorescent tube with primary reflector and beyond, and which may be used to retrofit existing high bay fixtures.
Figure 4:
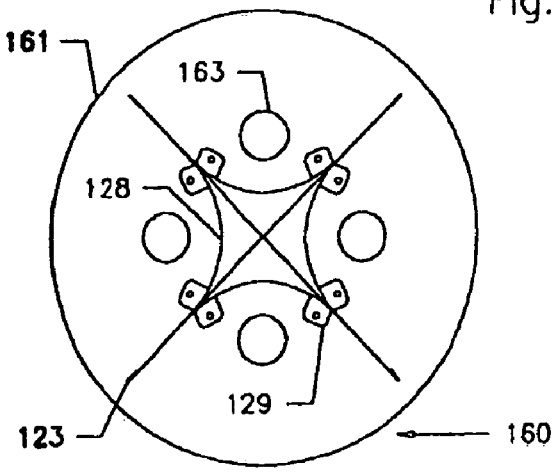
FIG. 4 is a top view of the invention of FIG. 3, further showing the orientation of secondary and third reflectors.

FIG. 3 discloses "implant" 160, described above, provided also with a third reflective mirror-like surface 161. The third reflector could be used as a secondary reflector 161 in cases were existing technology lamps are used. The implant may be set into an existing high bay enclosure for retrofitting. The height of the implants third reflector depends on condition of reflector 110. Light sockets 162 are provided to accept lamps or other light sources as previously described, and are typically of ceramic construction. As seen in FIG. 4, access holes 163 are provided in reflector 161, allowing for the installation of light source 122, also facilitating the passage of air through holes 163.

Figure 5:
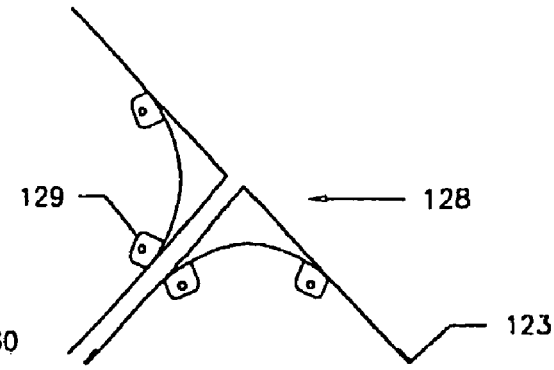
FIG. 5 is a top view of the secondary reflector of the invention disclosed in FIG. 3.

FIG. 5 further discloses secondary reflector 128, and tabs 129, used to fasten the reflector to reflector 161 of FIG. 4, typically by rivets or equivalent means. Folded metal slips 123 slip reflectors 128 together.

Figure 6A:
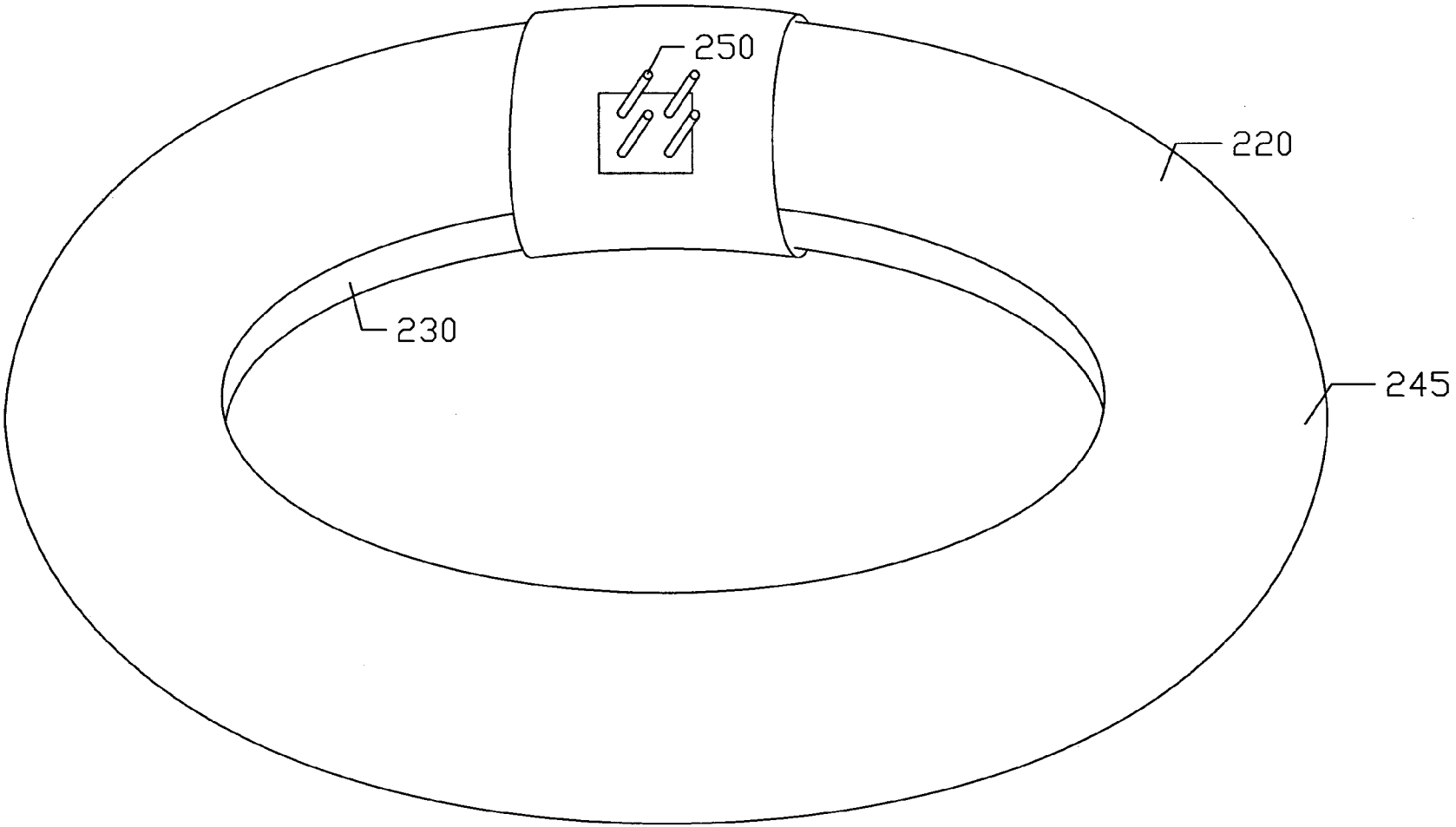
FIG. 6A is a side view of the lighting apparatus of FIG. 6 having a tubular housing of a circular shape.
Figure 6B:
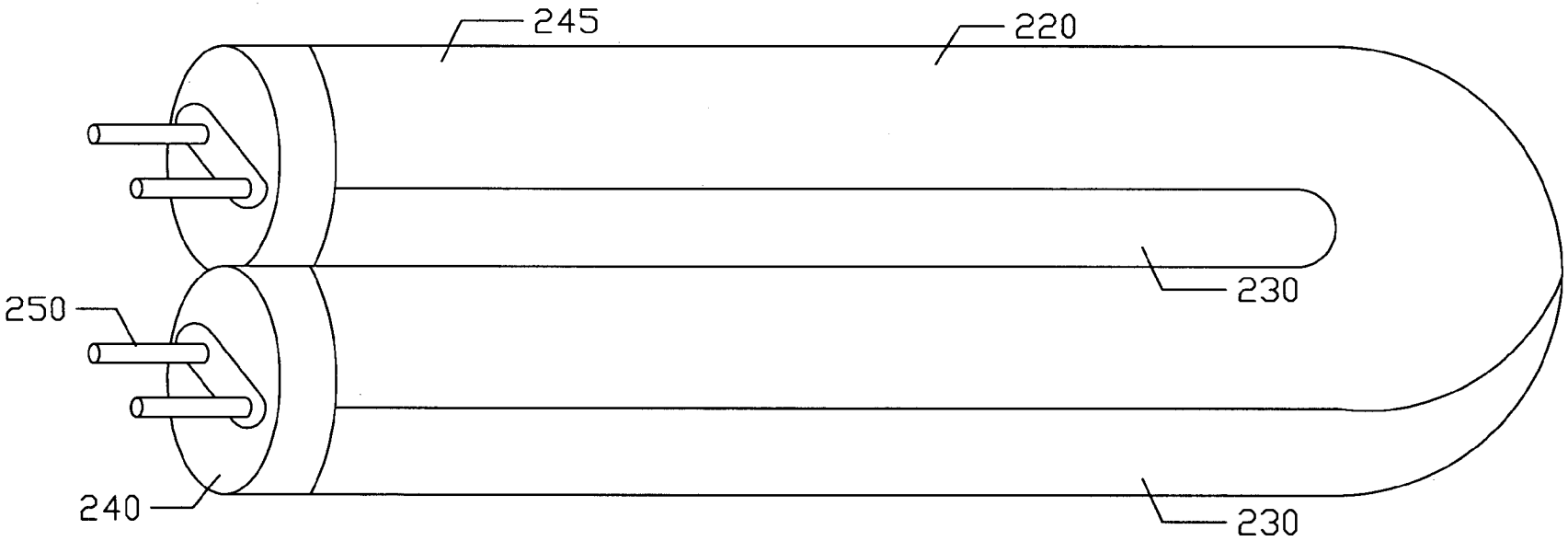
FIG. 6B is a side view of the lighting apparatus of FIG. 6 having a tubular housing of a U-shape.
Figure 6:
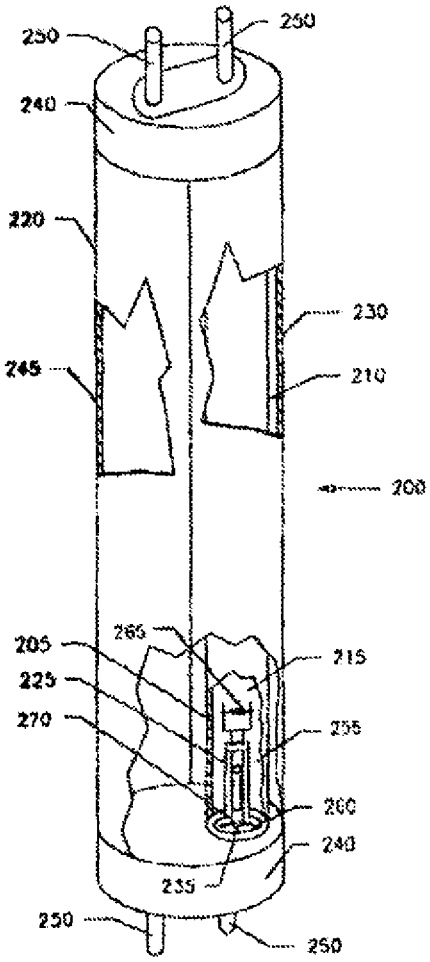
FIG. 6 is a side view of the fifth embodiment of applicant's invention, disclosing a smaller fluorescent tube proximate to the focal point of a larger cylindrical enclosure having a reflective hemisphere and manufactured as one piece.
Figure 1:
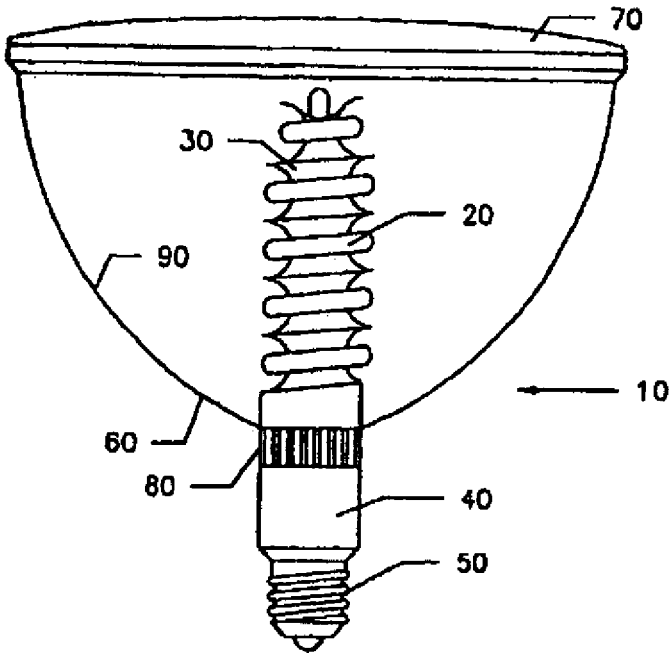
Figure 2:
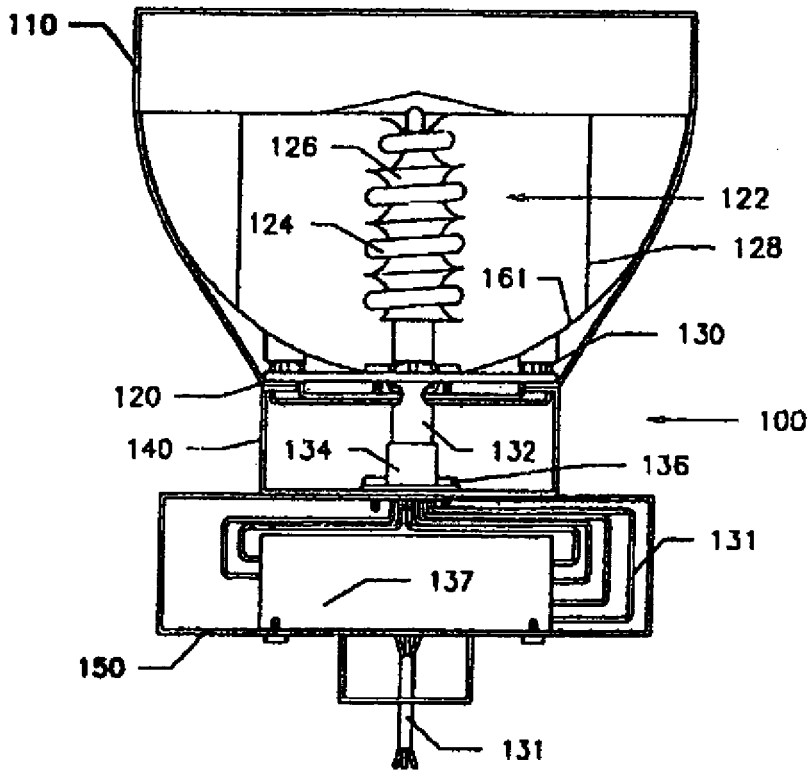
Figure 3:
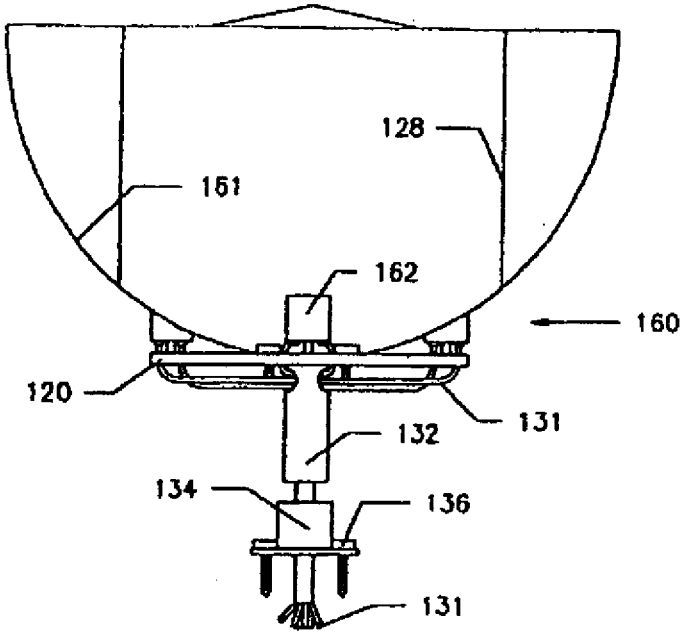
Figure 4:
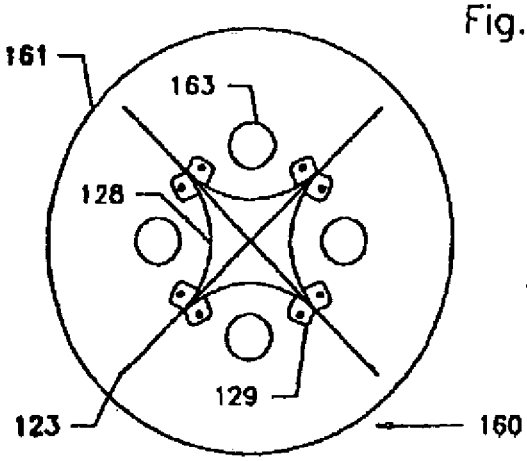
Figure 5:
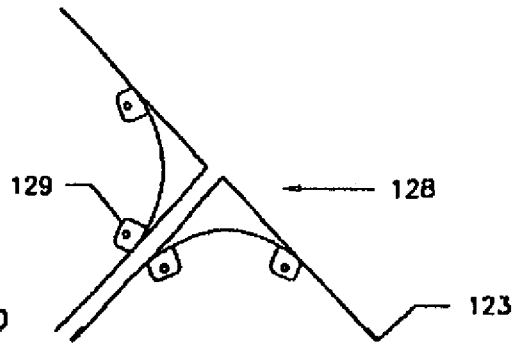
Figure 6:
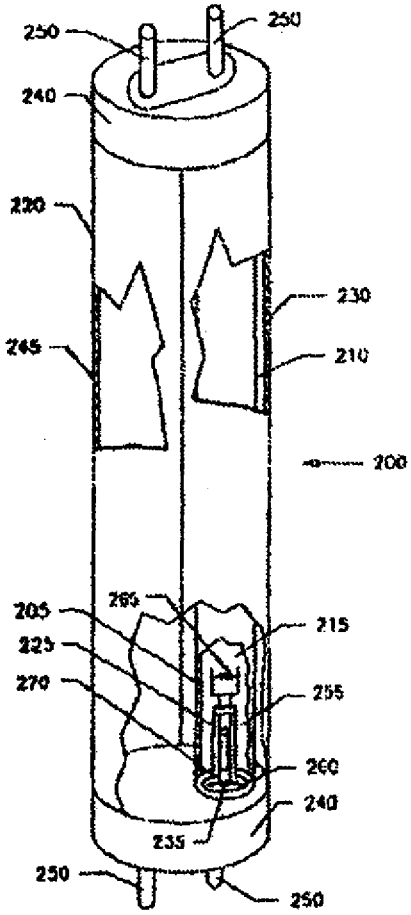
Figure 6A:
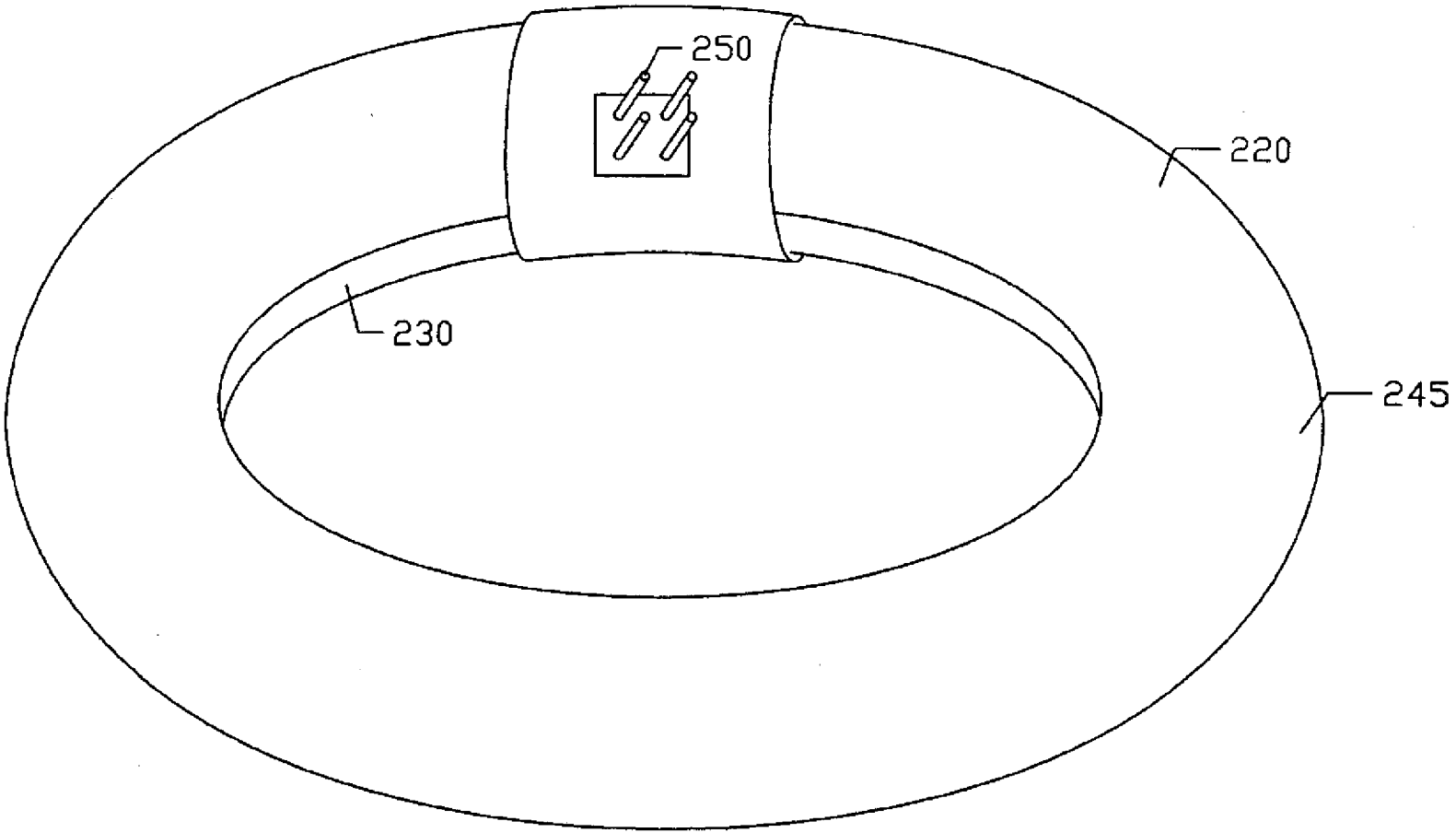
Figure 6B:
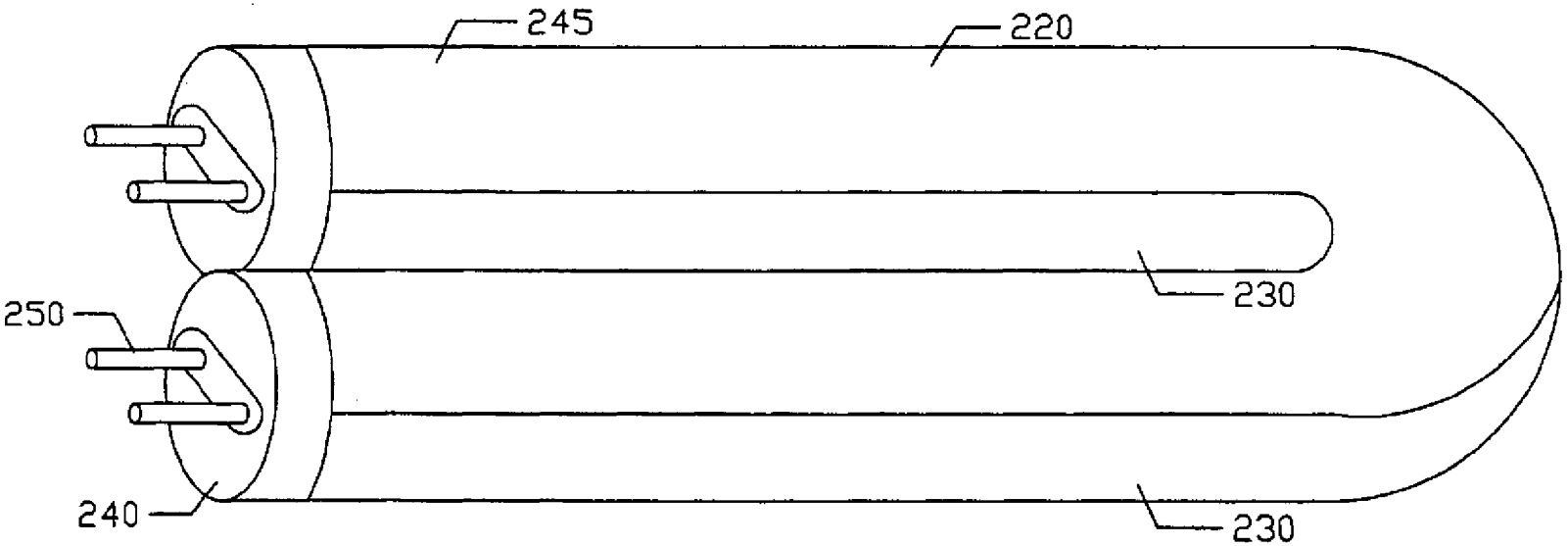
Figure 7:
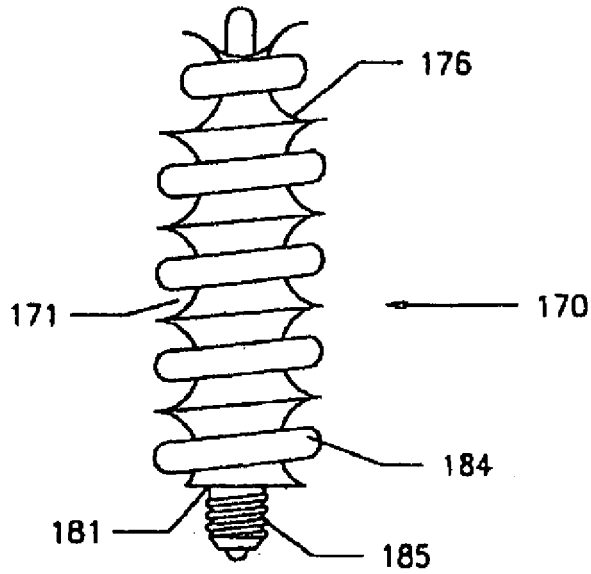
Figure 8:
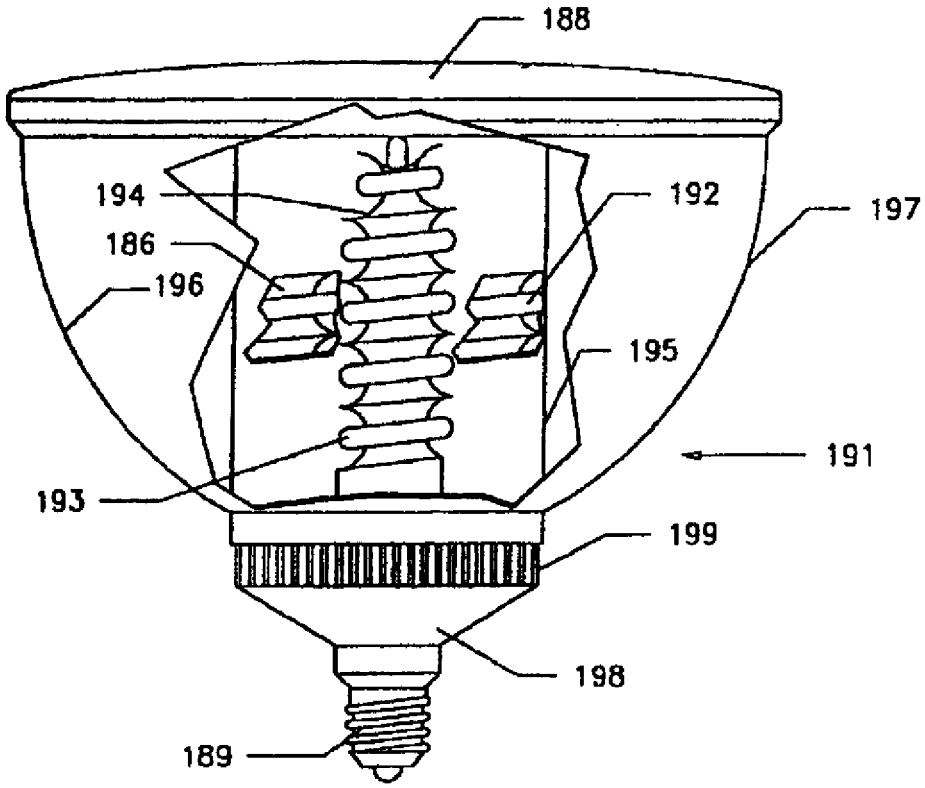
Figure 9:
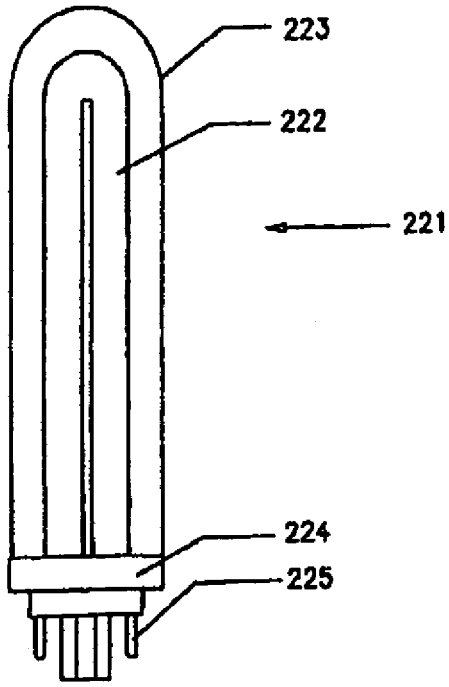
Figure 10:
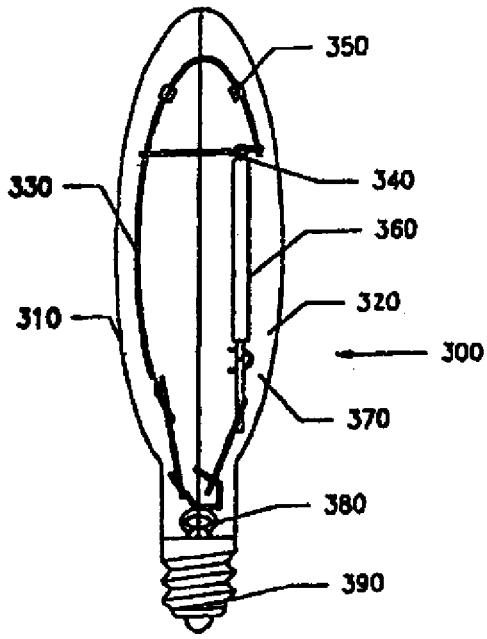
Figure 11:
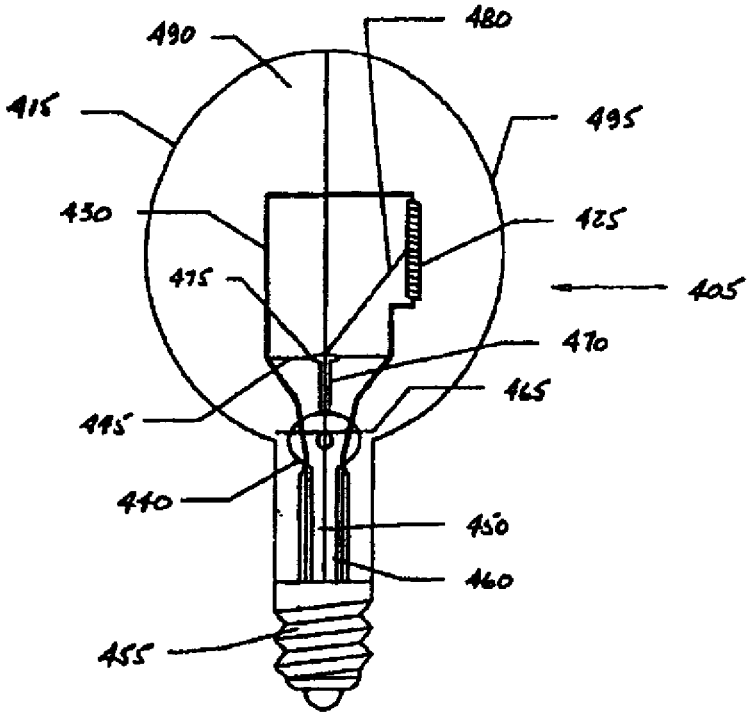
Figure 12:
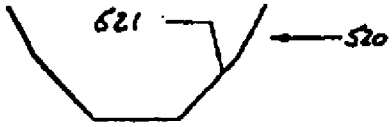
Figure 13:
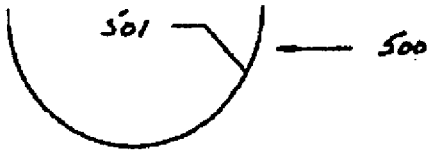
Figure 14:
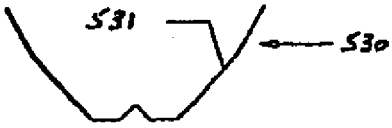
Figure 15:
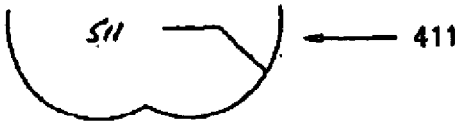
Figure 16:
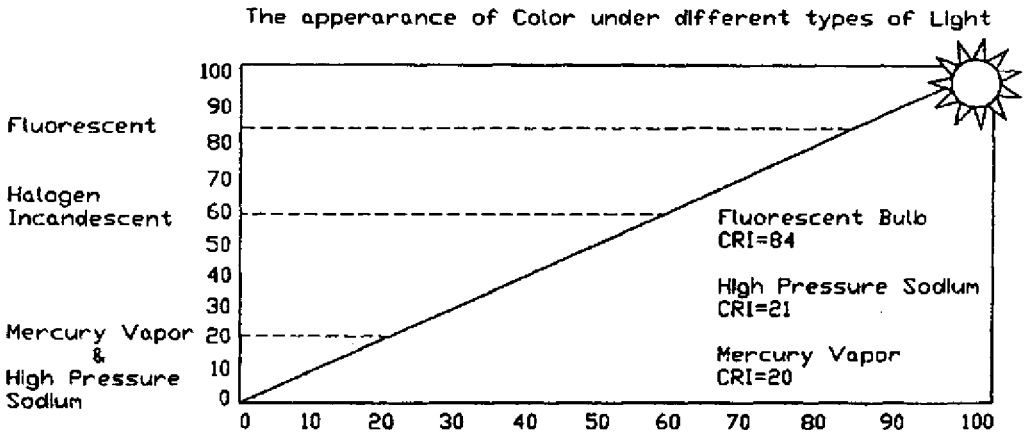
Figure 17:
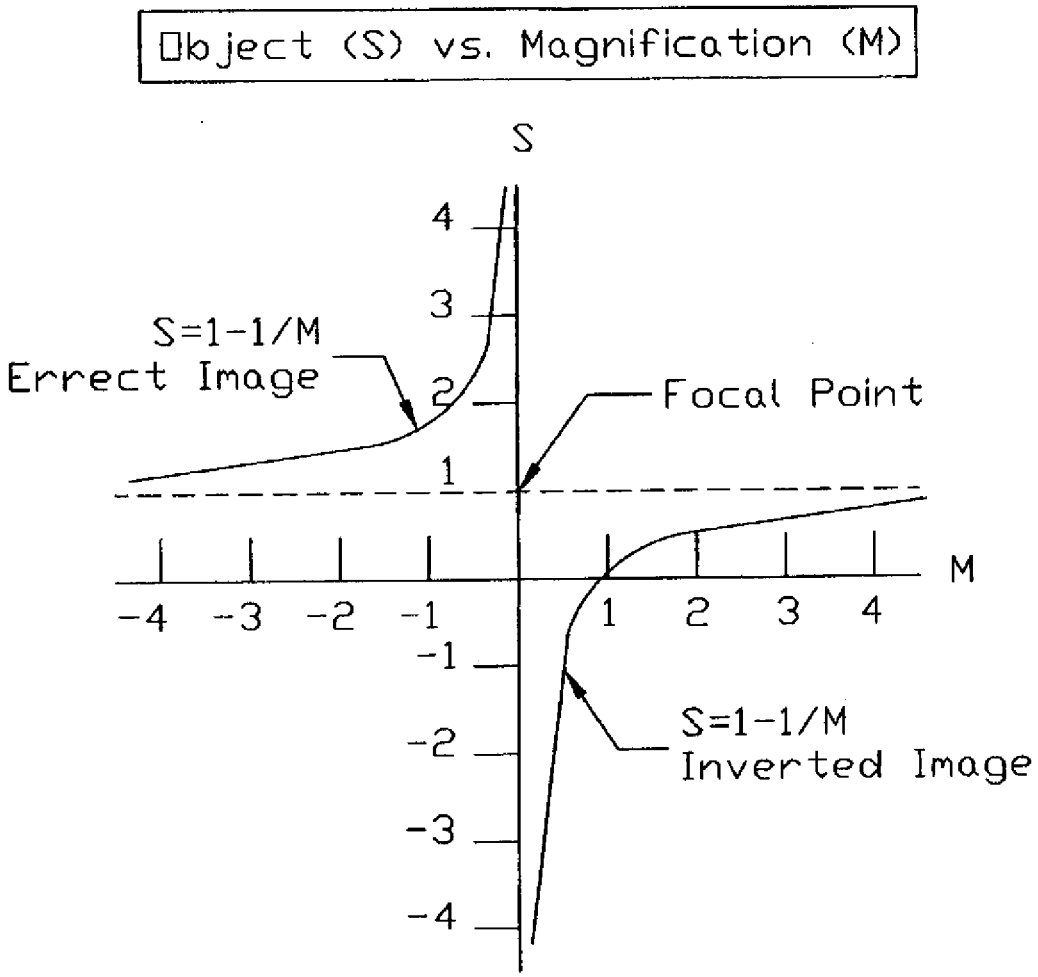

FIG. 6 shows what appears on the surface to be a standard fluorescent tube. However, FIG. 6 depicts a lighting apparatus 200, which comprises a first fluorescent tube 210. First fluorescent tube may include a bulb 255 with Phosphor coating inside the bulb 255. Cathodes 265 at each end of lamp are coated with emissive materials which emit electrons. Air is exhausted through a tube 270 during manufacture and a minute quantity of liquid mercury 205 is place in the bulb to furnish mercury vapor. Gas 215, usually comprises Argon or a mixture of inert gases at low pressure, but Krypton is sometimes used. Stem Press 225 includes lead-in wires that have an air tight seal here and are made of specific wire to assure about the same coefficient of expansion as the glass. Lead-in wires 235 connect to the base pins and carry the current to and from the cathodes and the mercury arc. The first fluorescent tube 210 housed in a larger cylindrical housing 220. Housing 220 is usually a straight glass tube, but may also be circular or U-shaped, and may be made of plastic, glass or other suitable material. Housing 220 has a reflective hemisphere 230, at the focal point of which is located tube 210, serving as a primary reflector. Several different types of base 240 used to connect the lamp to the electric circuit and to support the lamp in the lamp holder serve to position tube 210 in proper position in housing 220, and further provide penetrations whereby pins 250 may be in electrical contact with the circuitry 260 of tube 210. Of course, the primary reflective surface of hemisphere 230 is provided on the inside or outside of housing 220, which provides reflective capability for light emitted from tube 210. Lens 245 may be smooth, but could be designed to precisely control the light from the reflector. It is covered with small, detailed shapes to direct the light into the desired beam pattern. The lens also acts as a cover to allow the lamp to act as it own fixture. A common material for lens 245 can be glass or plastic or other suitable materials. Reflector 230 could also not be enclosed to save on material costs.

Lighting apparatus 200 depicted in FIG. 6 may be manufactured as one unit or the different elements of lighting apparatus 200 may be used separately with an adapter, The benefit of these separate elements is that standard "T5" units or equivalent fluorescent lamps can be replaced, but the other parts will continually last and not need replacement.

For example, base 240 and pins 250 may be in electrical contact with the circuitry of a tombstone. The tombstone positioned at the focal point of the base hemisphere 240 can hold the smaller pins used in T5 fluorescent lamps. Several different types of lamp pins maybe used to connect lamp 210 and the tombstone. Common materials for the adaptor tombstone, pins, and connectors could be metal, ceramic, plastic, or the equivalent.

Housing 220 of FIG. 6 may be provided in a number of suitable configurations, including a larger cylindrical housing. Housing 220 has a reflective hemisphere 230 with lens cover 245. Some common materials that could be used for housing 220 may be glass or plastic, or other suitable materials commonly employed in the art.

The fluorescent tube may also be combined with bases 240, pins 250, and fluorescent tube 210 as one unit.

Additionally or alternatively, lighting apparatus 200 may include enclosure caps and end caps with slots to hold pins 250 in place. Lighting apparatus 200 may also be employed in a secondary reflector, such as a wash board type reflective housing, thereby giving additional reflective assistance in delivering light to a target illumination area.

In lighting apparatus 200 depicted in FIG. 6 and disclosed hereinabove, standard type electrical connections including ballasts, sockets, and standard wiring are employed. Applicant's invention focuses primarily on the reflective aspects of providing additional light to a TIA, resulting in more lighting where desired with conservation of energy.

FIGS. 6A and 6B depict the housing 220 shown in FIG. 6 in circular and U-shapes, respectively, as discussed above.

Figure 7:
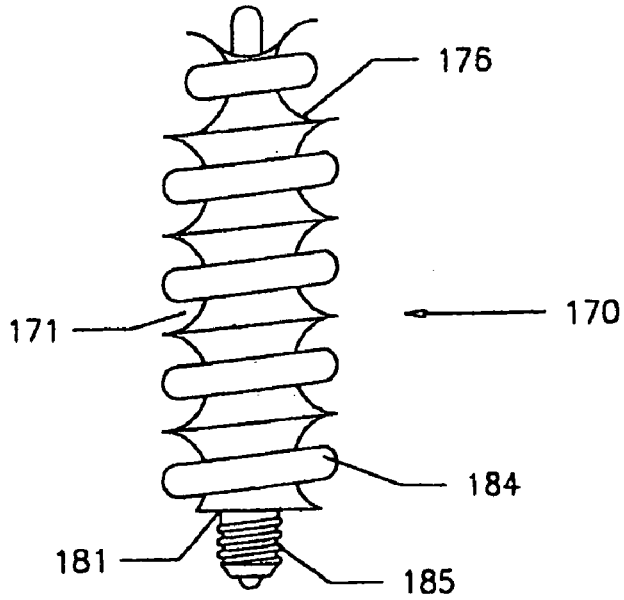
FIG. 7 is a side view of the aforementioned spiral compact fluorescent or fluorescent lamp, disclosing a smaller fluorescent spiral tube proximate to the focal point of a larger concave spiral reflector.

FIG. 7 discloses spiral compact fluorescent (or fluorescent lamp) 170 comprising a spiral compact fluorescent lamp 184 around which a primary reflector 176 is positioned. A first bonding means, such as glue or other adhesive or mechanical means is employ to fix lamp 184 and primary reflector 176 in a predetermined position. Ballast housing 181 for compact fluorescent lamp (or no ballast housing 181 for fluorescent lamp without ballast). In addition, housing 181 and screw plug 185 could be fashioned as one unit rather than as separate structures. Also air space 171, as heat dissipates cool air is drawn into space 171 cooling housing 181 and reflector 176.

Figure 8:
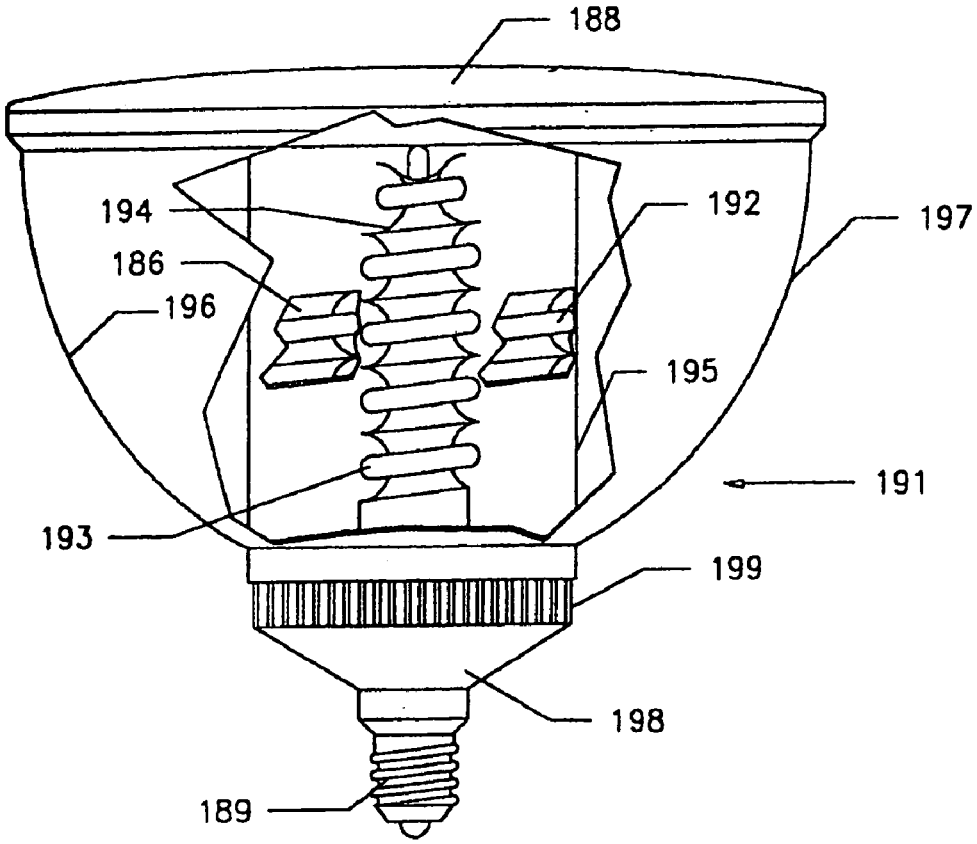
FIG. 8 is a side view of the aforementioned "HID" compact fluorescent lamp with an array of spiral fluorescent tubes with primary, secondary and third reflectors in a configuration commonly referred to as a "floodlight;"

FIG. 8 discloses the "HID" fluorescent lamp 191, of applicant's invention which is primarily employed as a retrofit of existing high bay fixtures. HID florescent lamp 191 holds an array 192 of fluorescent lamps 193 having primary reflectors 194. The array 192 further comprises a secondary reflector 195 commonly of assembled sections or one molded piece slips into a third reflective mirror-like surface 196 which is coated with a reflective material. The paraboloid shape housing 197 is made up of material like glass or plastic or other suitable equivalents. A variety of reflective materials may be used for reflectors 194, 195, and 196 including but not limited to chrome-plated glass, chrome-plated metal, polished or painted aluminum plate, painted glass, and plastic painted with a variety of reflective coatings. When utilizing molded metal for reflectors 194, 195, and 196 "mirro 4", "mirro 27" or white reflective aluminum may be selected. A first bonding means, such as glue or other adhesive or mechanical means is employed to fix lamp array 192 and primary reflector array 186 in a predetermined position relative to secondary 195 and third 196 reflectors housing. Commonly configured, a ballast housing 198, contains a ballast of either electrical or magnetic type, said ballast having a connecting means for electrical connection with lamp 193 and screw plug 189. A second bonding means is necessary to attach housing 198 to housing 197. Fins 199 are provided on ballast housing 198 to assist in dissipation of heat. A smooth lens 188 or a lens 188 designed to precisely control the light from the reflector is provided. Lens 188 covered with small, detailed shapes to direct the light into the desired beam pattern. The lens also acts as a cover to allow the lamp to act as its own fixture.

Figure 9:
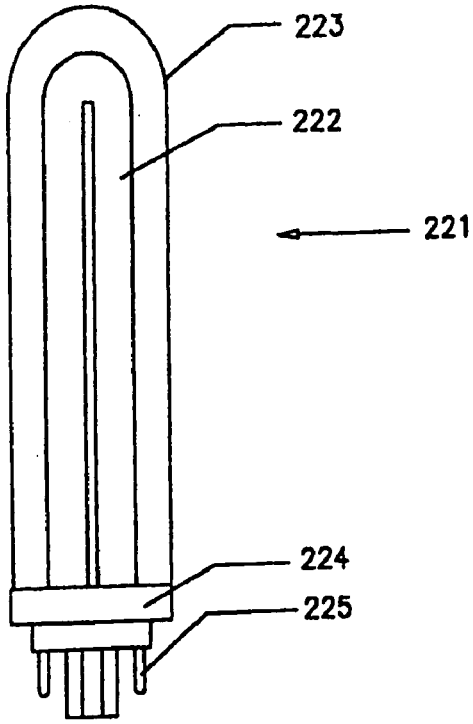
FIG. 9 is a side view of the invention, disclosing a smaller U-shaped fluorescent tube proximate to the focal point of an enclosed partially reflective tube or concave open reflector.

FIG. 9 shows a U-shaped fluorescent lamp 221 with tube 222 in a predetermined positioned of reflective surface 223. Tube 222 and reflector 223 are bonded to base 224 by glue or other mechanical means. Pin 225 and base 224 can be manufactured as one unit or as separate pieces. Many types of base 224 are used on the open market.

Figure 10:
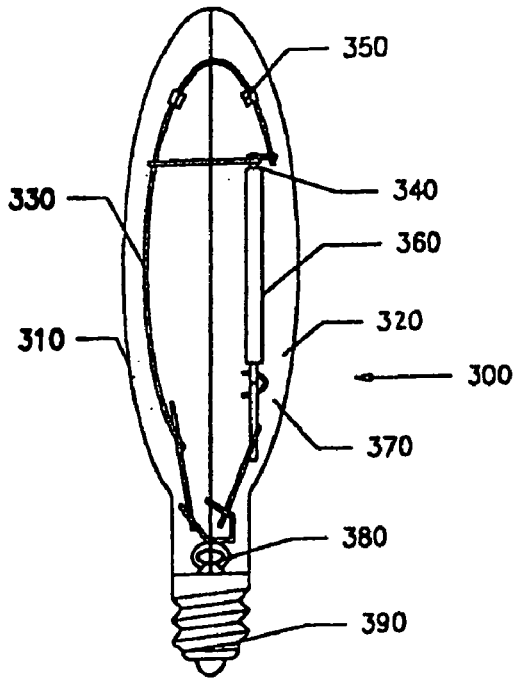
FIG. 10 is a side view of the invention, disclosing the HID high pressure sodium lamp with part of the glass envelope having reflective surface.

FIG. 10 discloses a high pressure sodium Lamp ("HPS") 300 comprising a glass envelope 310 having a substantially concave reflective surface 320. An arc tube 340, with hermetic end seal 360, typically an alumina arc tube or equivalent, is located proximate to the focal point of reflector 320 via a frame 330, usually steel. A residue gas repository 380 is positioned in lamp 300 on a base 390, where it is affixed in its location, and serves to support frame 330. Brass base 390 secures lamp 300 to a suitable light fixture and connects the light fixture's electric circuitry to the lamp. This lamp is made up of glass, metals, or other suitable materials commonly employed in the art.

Figure 11:
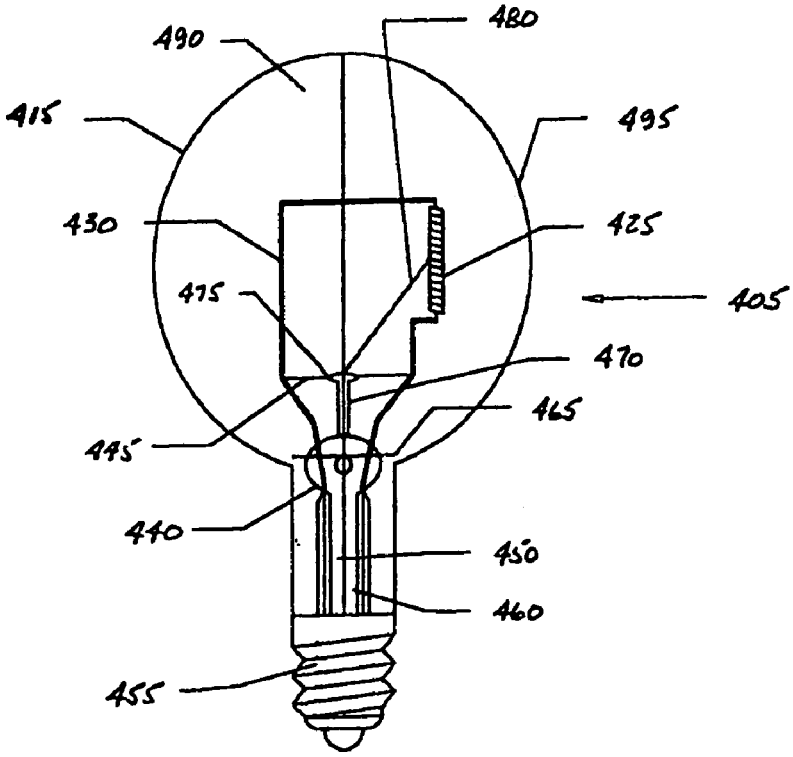
FIG. 11 is a side view of the invention, disclosing an incandescent lamp with part of the glass bulb as a reflective surface.

FIG. 11 shows an incandescent lamp 405 comprising a soft glass envelope 415. Filament 425, generally tungsten is electrically connected by wires 430 to a glass stem press 440. Wires 430 are made typically of nickel-plated copper or nickel from stem press 440 to filament 425. Tie wires 445 support wires 435 in the largest envelope area. Wires 430 pass through stem press 440, and an air evacuation tube 450 toward a base 455. In this stem press area, wires 430 transition from nickel-plated copper or nickel to a nickel-iron alloy core and a copper sleeve (Dumet wire). In this area, there exists an air tight seal at the termination of tube 450, said wires material change made to assure about the same coefficient of expansion of the wires as the glass, and air exhaust tube 450. Base 455 is made of brass or aluminum. A fuse 460 protects the lamp and circuit if filament 425 arcs. A heat deflector 465 is used in higher wattage general service lamps and other types when needed to reduce circulation of hot gases into neck of bulb.

Glass button rod 470 projects from stem press 440 and supports button 475. Button 475 has affixed thereto support wires 480 and 485. Gas 490 a mixture of nitrogen and argon is used in most lamps 40 watts and over to retard evaporation of the filament 425. A coating is applied to glass envelope 415, creating a substantially sphere-shaped reflective surface 495. Filament 425 is located proximate to the focal point of surface 495. The lamp is made of material like glass or plastic or other suitable equivalents.

Figure 12:
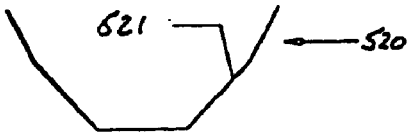
FIG. 12 is a side view of the aforementioned "reflector", disclosing a concave reflector.

FIG. 12, discloses reflector 500, a,concave reflector 501, made of a variety of reflective materials including but not limited to chrome-plated glass, chrome-plated metal, polished or painted aluminum plate, painted glass, and plastic painted with a variety of reflective coatings. When utilizing molded metal for reflector 500 "mirro 4", "mirro 27" or white reflective aluminum may be selected or other suitable equivalents.

Figure 13:
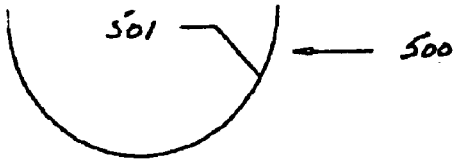
FIG. 13 is a side view of the aforementioned "reflector", disclosing a W-Shape reflector.

FIG. 13, discloses reflector 510, a W-shape reflector 511, again fashioned from a variety of reflective materials as mentioned in FIG. 12.

Figure 14:
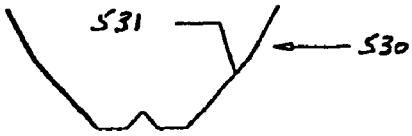
FIG. 14 is a side view of the aforementioned "reflector", disclosing a wash board reflector.

FIG. 14, discloses reflector 520, and a wash board shape reflector 521, again made from a variety of reflective materials as mentioned in FIG. 12.

Figure 15:
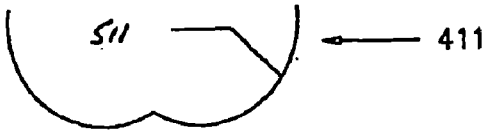
FIG. 15 is a side view of the aforementioned "reflector", disclosing a wash board shaped reflector.
Figure 16:
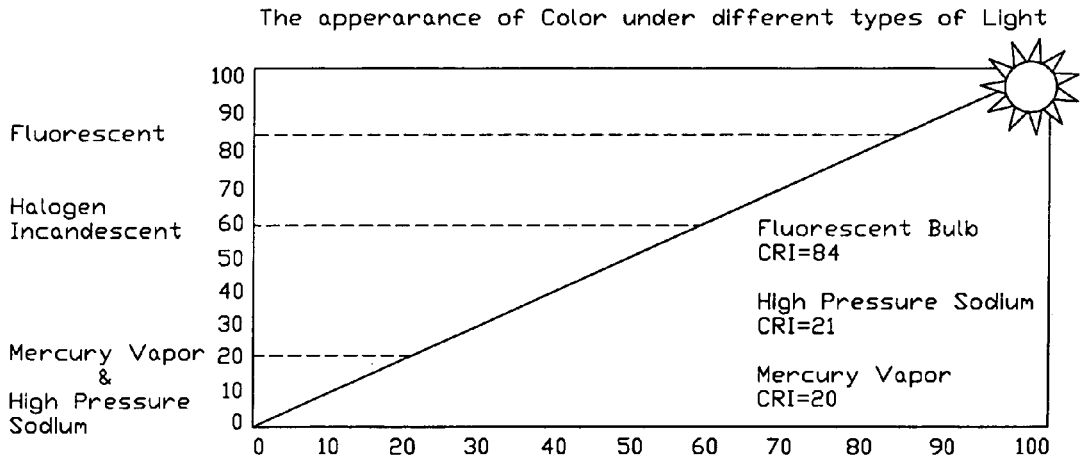
FIG. 16 is a graph showing the appearance of color under different types of light.
Figure 17:
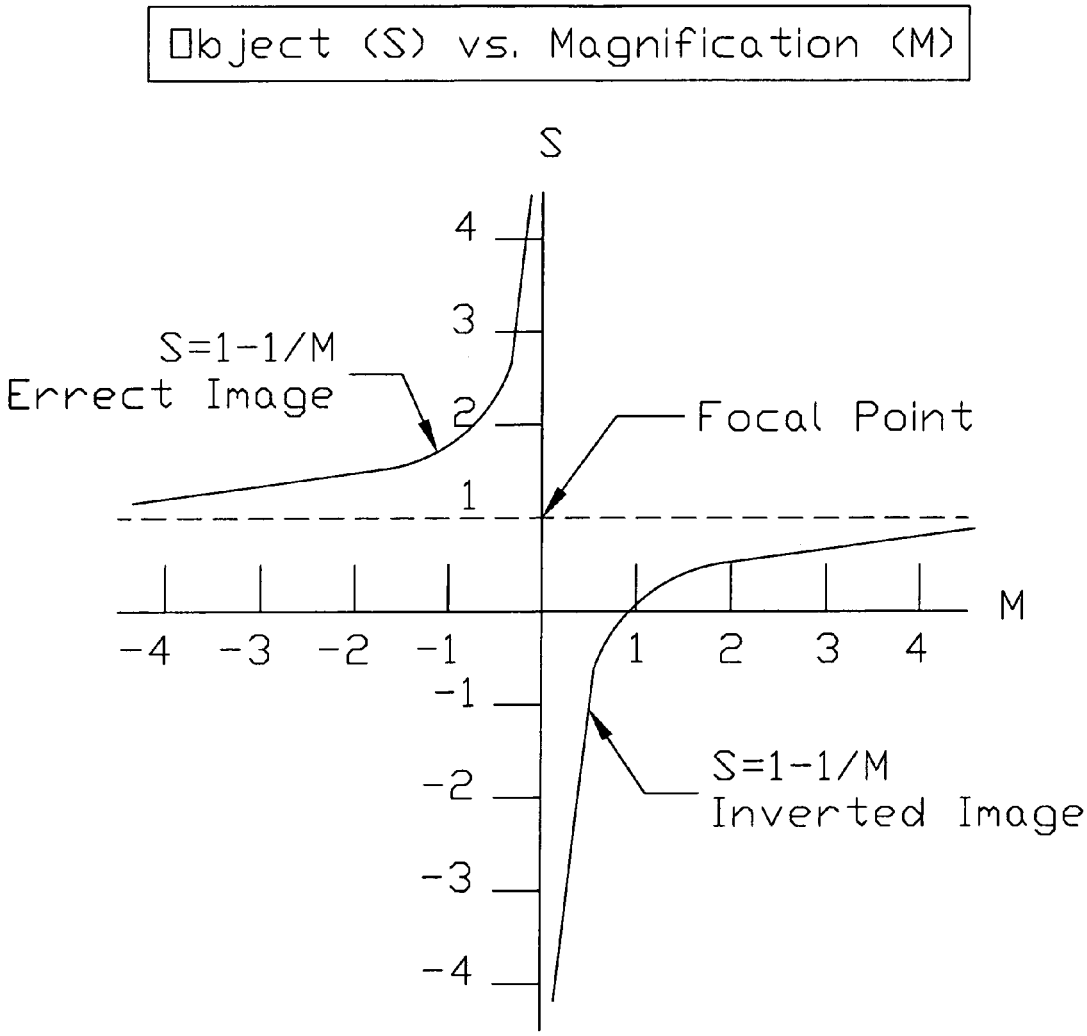
FIG. 17 is a graph showing the relationship between an object and magnification.

FIG. 15, discloses reflector 530, and a wash board shape reflector 531, both made from a variety of reflective materials as mentioned in FIG. 12.

In all embodiments disclosed hereinabove, standard type electrical connections including ballasts, sockets, and standard wiring are employed. Applicant's invention focuses primarily on the reflective aspects of providing additional light to a target illumination area, resulting in more lighting where desired with conservation of energy.

While the invention has been described in connection with what is presently considered the most practical and preferred embodiment(s), it is to be understood that the invention is not limited to the disclosed embodiment(s) but, on the contrary is intended to cover various modifications and equivalent arrangements included within the scope of the appended claims.

I claim:

1. An improved lighting apparatus comprising:

a flourescent lighting fixture of predetermined wattage, having a ballast and connecting means for a power source, said fixture further provided with slots at each end to accept cathodic pins of a fluorescent lamp;

a flourescent lamp of predetermined wattage and rating so as to be compatible with said fixture, said lamp having circuitry to allow current to flow from an outside power source into said lamp;

a tube having a substantially semi-cylindrical reflector attached thereto, the substantially semi-cylindrical reflector having an effective radius, an effective circumference, and a reflective surface on the concave side of the semi-cylindrical reflector, wherein the substantially semi-cylindrical reflector defines a focal point half the distance of the effective radius from the effective circumference;

a pair of end caps, said end caps centering said lamp inside said tube substantially at the focal point, said end caps each having a set of pins in electrical communication with said circuitry of said lamp such that when inserted into said fixture, said lamp may be energized by said ballast and thereby emit light.

2. The invention of claim 1 further comprising:

a secondary reflector affixed to said fixture, said secondary reflector having mirror-like qualities, said tube located proximate to the focal point of said secondary reflector.

3. The invention of claim 1 wherein:

said lamp, tube and endcaps being manufactured as a single unit.

4. The invention of claim 1 wherein:

said tube further comprises a lens having a lens surface with shapes on the lens surface to allow focusing of light emitted from said lamp and reflected from said substantially semi-cylindrical reflector.

5. The improved lighting apparatus of claim 1, wherein the reflective surface of the substantially semi-cylindrical reflector includes one or more of chrome-plated glass, chrome-plated metal, and polished aluminum plate.

6. The improved lighting apparatus of claim 1, wherein the reflective surface of the substantially semi-cylindrical reflector includes at least one of painted aluminum plate, painted glass, and painted plastic.

7. The improved lighting apparatus of claim 1, wherein the substantially semi-cylindrical reflector has a substantially C-shaped cross section.

8. The improved lighting apparatus of claim 1, wherein the substantially semi-cylindrical reflector has a substantially W-shaped cross section.

9. A fluorescent lighting fixture comprising:

a fluorescent tube adapted to emit light and including a phosphor coating and electrodes at opposite ends of the tube, the fluorescent tube enclosing mercury vapor and a gas adapted to ionize when subject to a voltage;

a tubular housing surrounding the fluorescent tube;

a base attached to one end of the tubular housing and adapted to couple to a ballast, the base configured to facilitate electrical communication between the electrodes in the fluorescent tube and the ballast in electrical communication with a power supply; and a reflector operatively connected to the tubular housing and having a reflective surface configured to define a focal point; and wherein the fluorescent tube is positioned within the tubular housing substantially at the focal point of the light reflected from the reflector.

10. The fluorescent lighting fixture of claim 9, wherein the tubular housing is a straight tube.

11. The fluorescent lighting fixture of claim 9, wherein the tubular housing is a substantially circular tube.

12. The fluorescent lighting fixture of claim 9, wherein the tubular housing is a substantially a U-shaped tube.

13. The fluorescent lighting fixture of claim 9, wherein the reflector has a substantially C-shaped cross section.

14. The fluorescent lighting fixture of claim 9, wherein the reflector has a substantially W-shaped cross section.

* * * * *

UNITED STATES PATENT AND TRADEMARK OFFICE

CERTIFICATE OF CORRECTION

PATENT NO. : 7,178,944 B2
APPLICATION NO. : 10/393816
DATED : February 20, 2007
INVENTOR(S) : Randal D. Walton It is certified that error appears in the above-identified patent and that said Letters Patent is hereby corrected as shown below:

Title Page, illustrative fig. 6 should be deleted and substitute therefore the attached title page consisting of illustrative fig. 6.

In the Drawings

The drawing sheet(s) consisting of fig(s) 6 is inserted as sheet 2 ½ of 9 as shown on the attached sheet.

Signed and Sealed this
Sixth Day of November, 2012

David J. Kappos

David J. Kappos
*Director of the United States Patent and Trademark Office*

(12) United States Patent
Walton

(10) Patent No.: US 7,178,944 B2
(45) Date of Patent: Feb. 20, 2007

(54) LIGHTING APPARATUS

(76) Inventor: Randal D. Walton, 4215 Plass Dr., Napa, CA (US) 94558

( * ) Notice: Subject to any disclaimer, the term of this patent is extended or adjusted under 35 U.S.C. 154(b) by 0 days.

(21) Appl. No.: 10/393,816

(22) Filed: Mar. 21, 2003

(65) Prior Publication Data

US 2004/0184269 A1 Sep. 23, 2004

(51) Int. Cl.
*F21V 23/02* (2006.01)

(52) U.S. Cl. ..... 362/260; 362/297; 362/307; 362/343; 313/113; 313/635

(58) Field of Classification Search ..... 362/223, 362/260, 307, 343, 297; 313/111, 113, 635
See application file for complete search history.

(56) References Cited

U.S. PATENT DOCUMENTS 3,179,792 A * 4/1965 Weiss ..... 313/113
3,558,873 A * 1/1971 Smith ..... 362/223
6,033,092 A * 3/2000 Simon ..... 362/260
6,356,700 B1 * 3/2002 Strobl ..... 362/297

* cited by examiner

*Primary Examiner*—Stephen F Husar
(74) *Attorney, Agent, or Firm*—Kolisch Hartwell, P.C.

(57) ABSTRACT

The present invention comprises a method of enhancing illumination by a variety of lamp types through the use of reflective technologies, for example, replacement of expensive high intensity density or mercury vapor lamps with low wattage flourescent tubes having at least one and in some cases, up to three reflective surfaces for focusing otherwise lost light toward a target illumination area. Further, the placement of light sources at the focal point of said reflective surfaces aids in optimizing the amount of light focused in a desired direction.

14 Claims, 9 Drawing Sheets

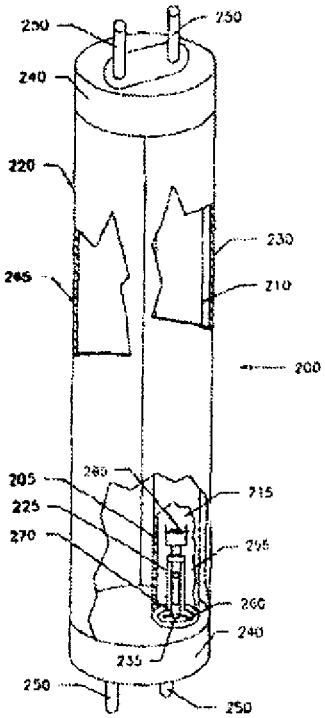

Fig. 6

UNITED STATES PATENT AND TRADEMARK OFFICE

CERTIFICATE OF CORRECTION

PATENT NO. : 7,178,944 B2
APPLICATION NO. : 10/393816
DATED : February 20, 2007
INVENTOR(S) : Randal D. Walton It is certified that error appears in the above-identified patent and that said Letters Patent is hereby corrected as shown below:

Title Page, illustrative fig. 6 should be deleted and substitute therefor the attached title page consisting of illustrative fig. 6 and corrected number of drawing sheets in patent.

In the Drawings

Delete Drawing Sheets 1-9 and substitute therefor the attached Drawing Sheets 1-10. Fig. 6 has been inserted as sheet 3 of 10.

This certificate supersedes the Certificate of Correction issued November 6, 2012.

Signed and Sealed this
Eleventh Day of December, 2012

David J. Kappos

David J. Kappos
*Director of the United States Patent and Trademark Office*

(12) United States Patent
Walton

(10) Patent No.: US 7,178,944 B2
(45) Date of Patent: Feb. 20, 2007

(54) LIGHTING APPARATUS

(76) Inventor: Randal D. Walton, 4215 Plass Dr., Napa, CA (US) 94558

( * ) Notice: Subject to any disclaimer, the term of this patent is extended or adjusted under 35 U.S.C. 154(b) by 0 days.

(21) Appl. No.: 10/393,816

(22) Filed: Mar. 21, 2003

(65) Prior Publication Data

US 2004/0184269 A1 Sep. 23, 2004

(51) Int. Cl.
*F21V 23/02* (2006.01)

(52) U.S. Cl. ..... 362/260; 362/297; 362/307; 362/343; 313/113; 313/635

(58) Field of Classification Search ..... 362/223, 362/260, 307, 343, 297; 313/111, 113, 635
See application file for complete search history.

(56) References Cited

U.S. PATENT DOCUMENTS 3,179,792 A * 4/1965 Weiss ..... 313/113
3,558,873 A * 1/1971 Smith ..... 362/223
6,033,092 A * 3/2000 Simon ..... 362/260
6,356,700 B1 * 3/2002 Strobl ..... 362/297

* cited by examiner

*Primary Examiner*—Stephen F Husar
(74) *Attorney, Agent, or Firm*—Kolisch Hartwell, P.C.

(57) ABSTRACT

The present invention comprises a method of enhancing illumination by a variety of lamp types through the use of reflective technologies, for example, replacement of expensive high intensity density or mercury vapor lamps with low wattage flourescent tubes having at least one and in some cases, up to three reflective surfaces for focusing otherwise lost light toward a target illumination area. Further, the placement of light sources at the focal point of said reflective surfaces aids in optimizing the amount of light focused in a desired direction.

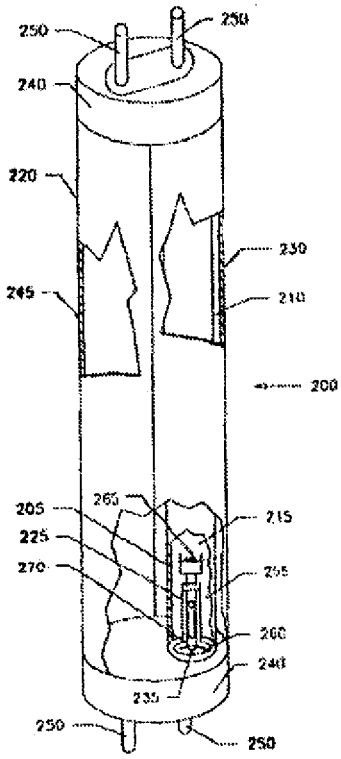

14 Claims, 10 Drawing Sheets